US009939749B2

(12) United States Patent
Wakimoto

(10) Patent No.: US 9,939,749 B2
(45) Date of Patent: Apr. 10, 2018

(54) IMAGE FORMING APPARATUS THAT REDUCES IMAGE QUALITY DETERIORATION CAUSED BY ADHESION OF PAPER POWDER AND SCATTERING OF TONER

(71) Applicant: Kyocera Document Solutions Inc., Osaka (JP)

(72) Inventor: Atsuhiro Wakimoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/675,805

(22) Filed: Aug. 14, 2017

(65) Prior Publication Data

US 2018/0059567 A1 Mar. 1, 2018

(30) Foreign Application Priority Data

Aug. 30, 2016 (JP) ..... 2016-168602

(51) Int. Cl.
*G03G 21/00* (2006.01)
*G03G 15/16* (2006.01)
(Continued)

(52) U.S. Cl.
CPC ..... *G03G 15/0189* (2013.01); *G03G 15/161* (2013.01); *G03G 15/162* (2013.01);
(Continued)

(58) Field of Classification Search
CPC .. G03G 15/0189; G03G 15/161; G03G 15/16; G03G 21/206; G03G 21/12; G03G 2215/00772; G03G 2215/0106; G03G 2215/0138; G03G 2215/1647; G03G 2215/1661
See application file for complete search history.

(56) References Cited

U.S. PATENT DOCUMENTS

2009/0226205 A1* 9/2009 Sato ..... G03G 15/161 399/101
2014/0212164 A1* 7/2014 Miyagawa ..... G03G 21/206 399/92
(Continued)

FOREIGN PATENT DOCUMENTS

JP 2012-159679 A 8/2012
JP 2015-025950 A 2/2015

*Primary Examiner* — Sophia S Chen
(74) *Attorney, Agent, or Firm* — James Judge

(57) ABSTRACT

An image forming apparatus includes an intermediate transfer belt and a developer unit. The image forming apparatus includes a cooling unit, a cleaning roller, and an auxiliary brush. The cooling unit cools a predetermined component by sending air by a fan inside the image forming apparatus. The cleaning roller removes remaining toner on the intermediate transfer belt at an upstream side of a region facing the developer unit in a rotationally moving direction of the intermediate transfer belt and at an upstream side of a region with which the image carrier is in contact in the intermediate transfer belt. The auxiliary brush located on an outer surface of the developer unit so as to close the clearance between the intermediate transfer belt and the developer unit and is in contact with the intermediate transfer belt to clean the intermediate transfer belt.

3 Claims, 6 Drawing Sheets

(51) Int. Cl.
*G03G 15/01* (2006.01)
*G03G 21/20* (2006.01)
*G03G 21/12* (2006.01)

(52) U.S. Cl.
CPC ..... *G03G 21/206* (2013.01); *G03G 21/12* (2013.01); *G03G 2215/00772* (2013.01); *G03G 2215/0106* (2013.01); *G03G 2215/0138* (2013.01); *G03G 2215/1661* (2013.01)

(56) References Cited

U.S. PATENT DOCUMENTS

2014/0321891 A1* 10/2014 Karashima ..... G03G 15/0189 399/314
2017/0017200 A1* 1/2017 Oya ..... G03G 21/206

* cited by examiner

IMAGE FORMING APPARATUS THAT REDUCES IMAGE QUALITY DETERIORATION CAUSED BY ADHESION OF PAPER POWDER AND SCATTERING OF TONER

INCORPORATION BY REFERENCE

This application is based upon, and claims the benefit of priority from, corresponding Japanese Patent Application No. 2016-168602 filed in the Japan Patent Office on Aug. 30, 2016, the entire contents of which are incorporated herein by reference.

BACKGROUND

Unless otherwise indicated herein, the description in this section is not prior art to the claims in this application and is not admitted to be prior art by inclusion in this section.

There is known a typical image forming apparatus that includes a cleaning roller for removing toner (hereinafter referred to as "remaining toner") that remains on an intermediate transfer belt without being transferred onto a transfer material such as a paper. There is proposed an image forming apparatus that includes a brush roller as a cleaning roller. This image forming apparatus houses the cleaning roller in a casing. The toner removed from the intermediate transfer belt by the cleaning roller accumulates on a bottom portion of the casing and is conveyed to a waste-toner container by a toner-recovery screw.

An image forming apparatus internally includes a fan to prevent a failure caused by a temperature rise regarding a predetermined component. There is also proposed an image forming apparatus that cools a developer unit with a fan. Since an internal temperature rise causes a failure such as toner melt, this image forming apparatus cools the developer unit.

SUMMARY

An image forming apparatus according to one aspect of the disclosure includes an intermediate transfer belt and a developer unit. A toner image formed on an image carrier is transferred on to the intermediate transfer belt. The developer unit faces the intermediate transfer belt with a clearance and forms the toner image by supplying toner to the image carrier. The image forming apparatus rotatably drives the intermediate transfer belt, transfers the toner image formed on the image carrier onto the intermediate transfer belt, and forms an image by transferring the toner image transferred onto the intermediate transfer belt onto a transfer material. The image forming apparatus includes a cooling unit, a cleaning roller, and an auxiliary brush. The cooling unit cools a predetermined component by sending air by a fan inside the image forming apparatus. The cleaning roller removes remaining toner on the intermediate transfer belt at an upstream side of a region facing the developer unit in a rotationally moving direction of the intermediate transfer belt and at an upstream side of a region with which the image carrier is in contact in the intermediate transfer belt. The auxiliary brush located on an outer surface of the developer unit so as to close the clearance between the intermediate transfer belt and the developer unit and is in contact with the intermediate transfer belt to clean the intermediate transfer belt.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
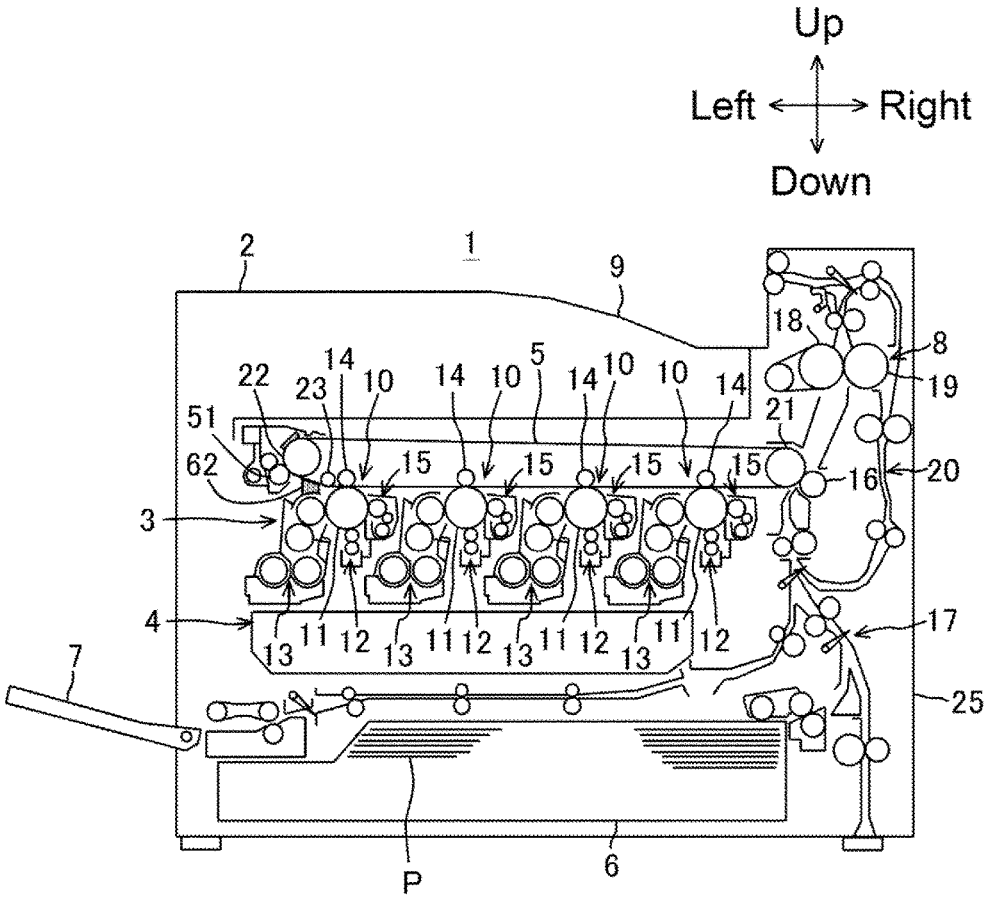
FIG. 1 illustrates an overall view illustrating a schematic constitution of an image forming apparatus according to an embodiment.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings in detail. The disclosure is not limited to the following embodiments.

Embodiment

FIG. 1 illustrates a schematic constitution of an image forming apparatus 1 according to the embodiment of the disclosure. In the following description, assume that the front side and the rear side mean a front side and a rear side of the image forming apparatus 1 (a near side and the far side in a direction perpendicular to the paper surface in FIG. 1), and the left side and the right side mean a left side and a right side when the image forming apparatus 1 is viewed from the front side.

The image forming apparatus 1 is a tandem type color printer and includes an image forming apparatus body 2 covered by a box-shaped casing 25. Inside the image forming apparatus body 2, an image forming unit 3 is located. The image forming unit 3 transfers and forms an image on a recording sheet P (a transfer material P) based on image data transmitted from an external device such as a computer, which is, for example, connected to a network.

Below the image forming unit 3, a light scanning device 4 that emits a laser beam is located. On the upper side of the image forming unit 3, an intermediate transfer belt 5 to which toner images formed on respective photoreceptor drums 11 (respective image carriers 11) in the image forming unit 3 is transferred is located. The intermediate transfer belt 5 is wound around a drive roller 21 and a driven roller 22 and is stretched in a lateral direction between these rollers 21 and 22. The intermediate transfer belt 5 is rotatably driven to be able to be brought in contact with the respective photoreceptor drums 11 by a first drive motor (not illustrated) that rotates the drive roller 21.

Below the light scanning device 4, a paper sheet storage unit 6 that stores the recording sheet P is located. On the left side of the paper sheet storage unit 6, a manual paper feed tray 7 is located. On a right side and above the intermediate transfer belt 5, a fixing unit 8 that performs a fixing process on the image transferred and formed on the recording sheet P is located. In an upper portion of the image forming apparatus body 2, a paper sheet discharge unit 9 where the recording sheet P with the fixing process performed at the fixing unit 8 is discharged is located.

Figure 2:
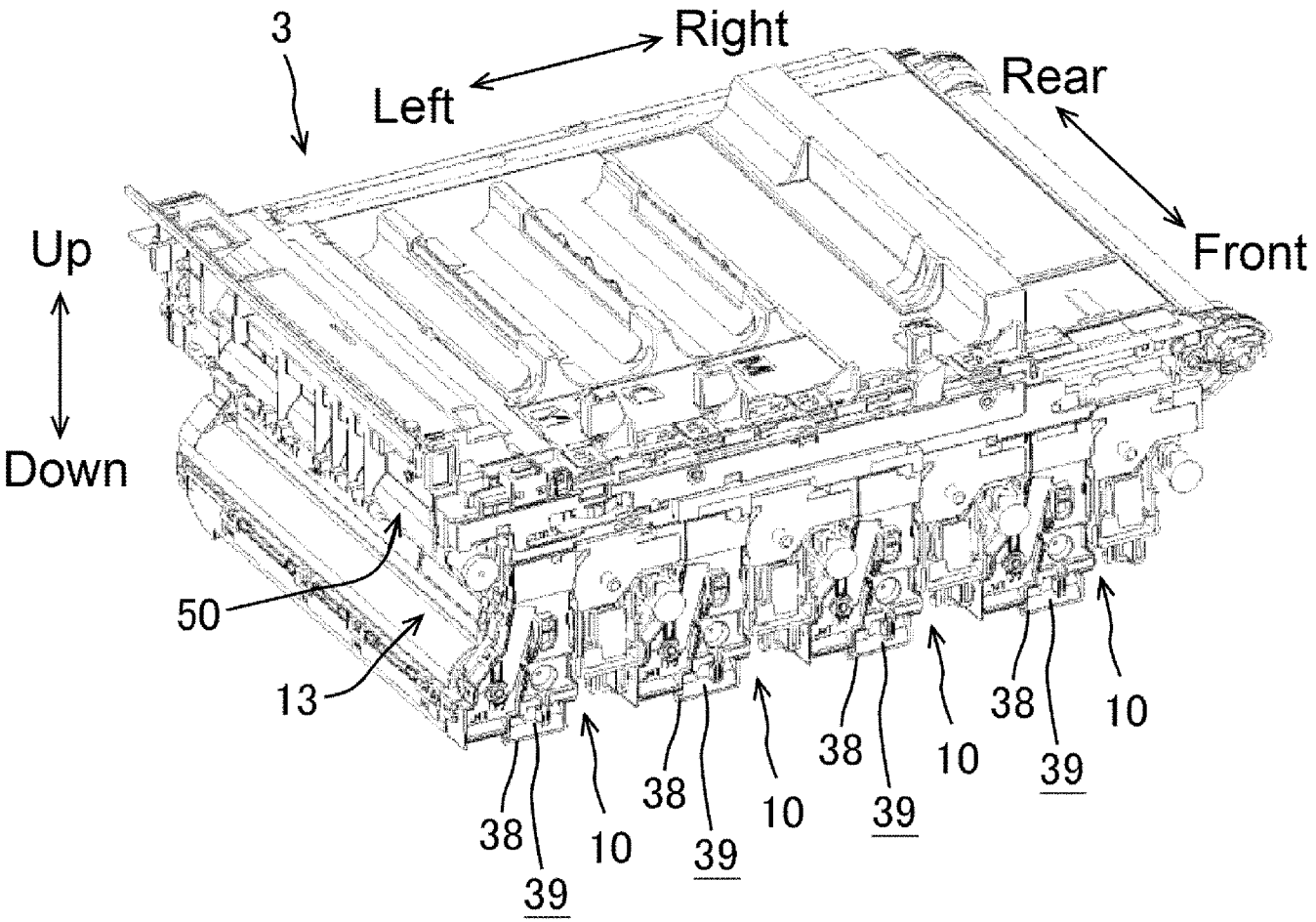
FIG. 2 obliquely illustrates an image forming unit in the image forming apparatus.
Figure 3:
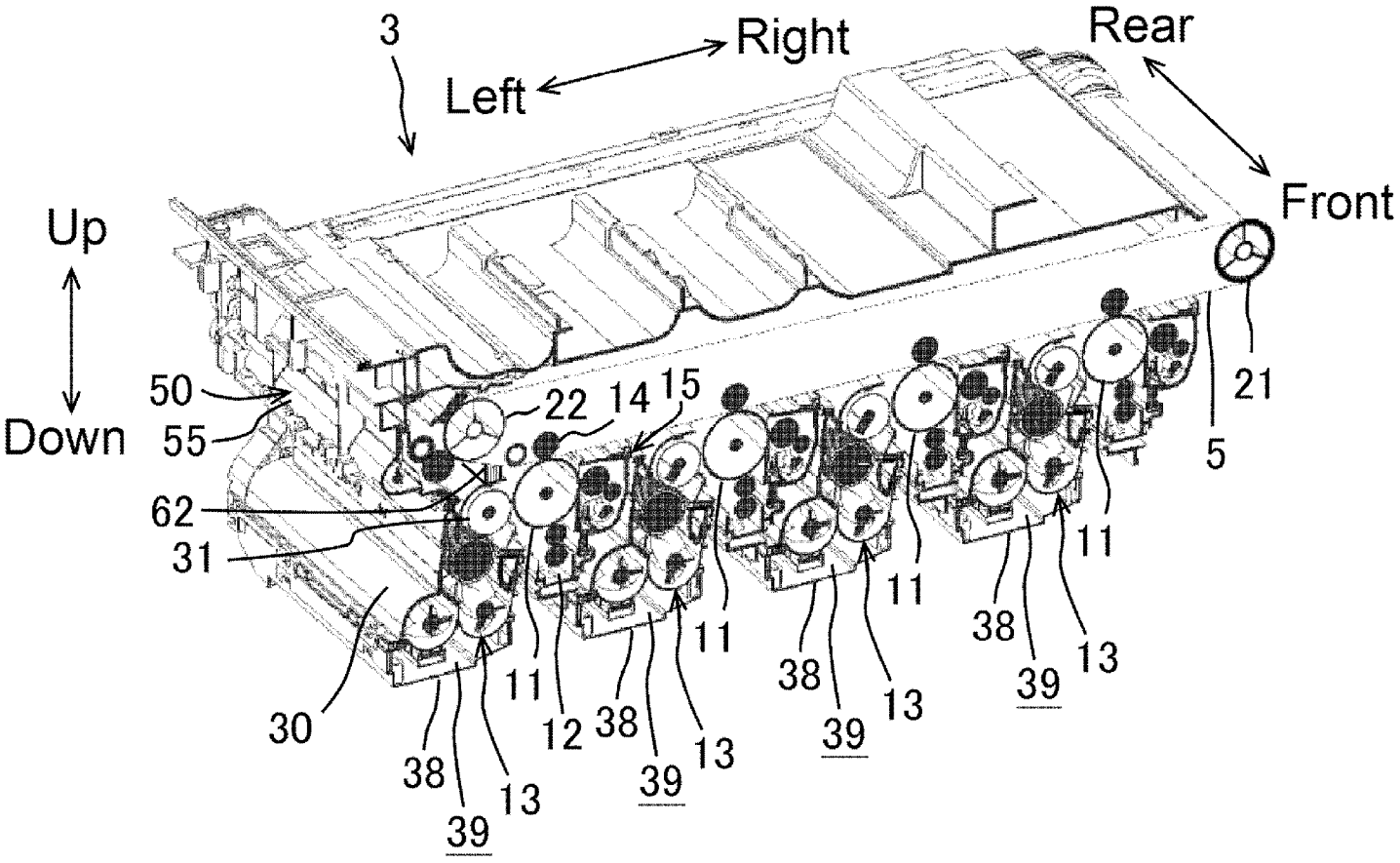
FIG. 3 illustrates a cross-sectional view of the image forming unit in the image forming apparatus.

The image forming unit 3, as illustrated in FIGS. 2 and 3, includes a plurality of image forming units 10 (four image forming units 10 corresponding to respective colors of magenta, cyan, yellow, and black). The plurality of image forming units 10 are arranged in one row along a lower side portion of the intermediate transfer belt 5. Each of the image forming units 10 includes the photoreceptor drum 11, a charger 12, a developer unit 13, a primary transfer roller 14, and a cleaning unit 15. The photoreceptor drum 11 is rotatably driven. The charger 12 is arranged immediately below each of the photoreceptor drums 11. The developer unit 13 is located on a left side of each of the photoreceptor drums 11. The primary transfer roller 14 is located immediately above each of the photoreceptor drums 11. The cleaning unit 15 is located on a right side of each of the photoreceptor drums 11. Of the image forming unit 3, the photoreceptor drum 11, the charger 12, and the cleaning unit 15 constitute a drum unit. The developer unit 13 will be described later in detail.

After the circumference surface of each of the photoreceptor drums 11 is charged at a constant level by the charger 12, irradiating the circumference surface of the photoreceptor drum 11 after the charge with a laser beam based on predetermined image data from the light scanning device 4 forms an electrostatic latent image on the circumference surface of each of the photoreceptor drums 11. With respect to this electrostatic latent image, a toner (developer) is supplied from the developer unit 13. Consequently, the toner images of yellow, magenta, cyan, or black are formed on the respective circumference surfaces of the photoreceptor drums 11. The toner images formed on the respective circumference surfaces of the photoreceptor drums 11 are transferred onto the circumference surface of the intermediate transfer belt 5 by a transfer bias applied to the primary transfer roller 14. The toner remaining on the circumference surface of the photoreceptor drum 11 without having been transferred onto the intermediate transfer belt 5 is cleaned by the cleaning unit 15. Rotational driving of the intermediate transfer belt 5 causes the toner image of respective colors of yellow, magenta, cyan, and black to be transferred in order such that the toner images are overlapped with one another and thus forms a color toner image on the circumference surface of the intermediate transfer belt 5.

Below the fixing unit 8, a secondary transfer roller 16 and the drive roller 21 that is opposed to the secondary transfer roller 16 are located. The secondary transfer roller 16 is arranged adjacent to the drive roller 21 so as to contact the drive roller 21 via the intermediate transfer belt 5. The secondary transfer roller 16 is in contact with the intermediate transfer belt 5. The recording sheet P, which is conveyed through a paper sheet conveyance passage 17 from the paper sheet storage unit 6 or the manual paper feed tray 7, is sandwiched by the secondary transfer roller 16 and the intermediate transfer belt 5, and then the toner image onto the intermediate transfer belt 5 is transferred onto the recording sheet P by the transfer bias applied to the secondary transfer roller 16. A color image is formed on the recording sheet P.

The fixing unit 8 includes a heating roller 18 and a pressure roller 19. The fixing unit 8 performs a fixing process that fixes the toner images transferred onto the recording sheet P by heating the recording sheet P, while sandwiching and pressuring the recording sheet P by the heating roller 18 and the pressure roller 19. The recording sheet P after the fixing process is discharged to the paper sheet discharge unit 9. When performing duplex printing, the image forming apparatus 1 causes the recording sheet P, where the fixing process has been performed on a front-side toner image, to pass through an inverting conveyance path 20 to be inverted and prints an image on the back side of the recording sheet P.

Constitutions of Developer Unit and Cooling Unit

Figure 4:
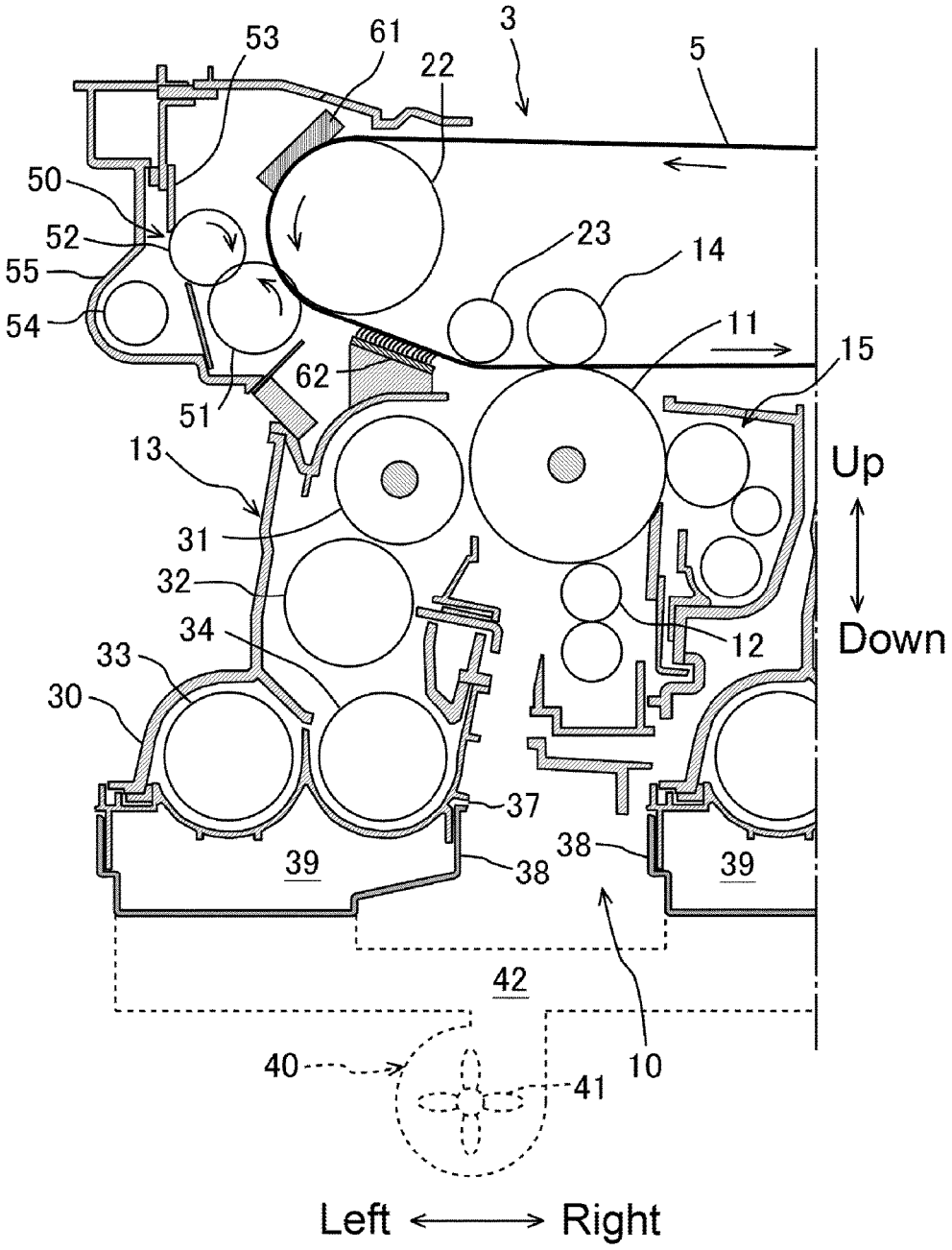
FIG. 4 illustrates a cross-sectional view of a driven roller side in the image forming unit.

FIG. 4 illustrates a cross-sectional view of the driven roller 22 side in the image forming unit 3. FIG. 4 illustrates rotation directions of the components that are rotatably driven by arrows. In the image forming unit 10, the developer unit 13 is located on an upstream side with respect to the photoreceptor drum 11 in the rotation direction (a moving direction of the lower side portion of the intermediate transfer belt 5) of the intermediate transfer belt 5. The top surface of the developer unit 13 faces a lower surface of the intermediate transfer belt 5 with a clearance. The developer unit 13 includes a developing roller 31, a mag roller 32, a first spiral feeder 33, and a second spiral feeder 34 inside a casing 30. Inside the casing 30, the toner replenished from a toner container (not illustrated) is retained.

In the developer unit 13, the first spiral feeder 33 axially conveys the toner while stirring the toner. The second spiral feeder 34 conveys the toner, which is delivered from the first spiral feeder 33, in a direction opposite to the first spiral feeder 33. The mag roller 32 recovers the toner conveyed by the second spiral feeder 34 by magnetic force and supplies to the developing roller 31. The developing roller 31 receives the toner conveyed from the mag roller 32 and supplies in a latent image region on the circumference surface of the photoreceptor drum 11. The developing roller 31 is exposed from an opening of the casing 30 and faces the photoreceptor drum 11 with a slight interval.

As illustrated in FIG. 4, the image forming apparatus 1 further includes a cooling unit 40 that cools a predetermined component (in the embodiment, the developer unit 13). The cooling unit 40 includes a blast fan (also referred to as a fan) 41 and a duct-forming member 38. The blast fan 41 sends air. The duct-forming member 38 forms a cooling duct 39 through which the air supplied by the blast fan 41 flows. In the embodiment, one blast fan 41 is located for two developer units 13, and one duct-forming member 38 is located for each of the developer units 13.

The duct-forming member 38 is formed in a box shape with an opened upper portion. The duct-forming member 38 is mounted in a lower portion of the casing 30 to form the cooling duct 39 with a bottom surface of the casing 30. The cooling duct 39 extends along an axial direction (a front-rear direction) of the developing roller 31. The blast fan 41 is located, for example, in a side portion (a side portion in the front-rear direction) of the light scanning device 4. The air blown out of the blast fan 41 flows in one end of the cooling duct 39 through a communication passage 42 and flows through the cooling duct 39 along the axial direction of the developing roller 31. The toner inside the casing 30 dissipates heat to the air flowing through the cooling duct 39 and is cooled. The air having flowed through the cooling duct 39 is discharged from the other end of the cooling duct 39.

Constitution of Belt Cleaning Unit

As illustrated in FIGS. 3 and 4, the image forming apparatus 1 further includes a belt cleaning unit 50. The belt cleaning unit 50 removes a remaining toner remaining on the intermediate transfer belt 5 without being transferred onto the recording sheet P and paper powder attached to the intermediate transfer belt 5. The belt cleaning unit 50 includes a cleaning roller 51, a recovery roller 52, a cleaning blade 53, and a toner-recovery screw 54 inside a casing 55.

The cleaning roller 51 is a roller for removing the remaining toner from the circumference surface of the intermediate transfer belt 5. The cleaning roller 51 is constituted of a conductive brush where a plurality of brush bristles are planted over the circumference surface. In the intermediate transfer belt 5, the cleaning roller 51 is in contact with the intermediate transfer belt 5 at an upstream side of a region that faces the developer unit 13 at the most upstream side in its rotationally moving direction and at an upstream side of a region where the photoreceptor drum 11 at the most upstream side is brought in contact, so as to remove the remaining toner on the intermediate transfer belt 5. The cleaning roller 51 is located so as to sandwich the intermediate transfer belt 5 with the driven roller 22.

The cleaning roller 51 is rotatably driven by a second drive motor (not illustrated) during the image formation by the image forming unit 3. The cleaning roller 51 is rotatably driven such that the brush bristles move in a direction opposite to the intermediate transfer belt 5 at a contact position with the intermediate transfer belt 5. In that case, a predetermined electric potential difference is given between the cleaning roller 51 and the intermediate transfer belt 5 by a constant current source (not illustrated), and current flows between the cleaning roller 51 and the intermediate transfer belt 5. This causes the remaining toner on the circumference surface of the intermediate transfer belt 5 to move to the cleaning roller 51.

The recovery roller 52 is a roller for recovering the toner, which has moved to the cleaning roller 51 from the intermediate transfer belt 5. The recovery roller 52 is rotatably driven synchronously with the cleaning roller 51 by the above-described second drive motor. The recovery roller 52 is rotatably driven such that its circumference surface moves in an identical direction with the cleaning roller 51 at a contact position with the cleaning roller 51. In that case, a predetermined electric potential difference is given between the recovery roller 52 and the cleaning roller 51 by a constant current source (not illustrated), and current flows between the recovery roller 52 and the cleaning roller 51. This causes the toner attached on the cleaning roller 51 to move to the recovery roller 52.

The cleaning blade 53 is a component for scraping off the toner attached to the circumference surface of the recovery roller 52. The cleaning blade 53 is arranged so as to be brought in contact with the circumference surface of the recovery roller 52. The toner scraped off by the cleaning blade 53 accumulates in a bottom portion of the casing 55 and then is conveyed to a waste-toner container (not illustrated) by the toner-recovery screw 54.

In the embodiment, the belt cleaning unit 50 further includes a first auxiliary brush 61 (a pre-brush 61) and a second auxiliary brush 62. The first auxiliary brush 61 is arranged on an upstream side of the cleaning roller 51 in a rotation direction of the intermediate transfer belt 5, and the second auxiliary brush 62 is located on a downstream side of the cleaning roller 51 in the rotation direction of the intermediate transfer belt 5.

The first auxiliary brush 61 is a brush for peeling off the remaining toner attached on the surface of the intermediate transfer belt 5 from the surface, prior to removal of the toner by the cleaning roller 51. The first auxiliary brush 61 is located so as to sandwich the intermediate transfer belt 5 with the driven roller 22 by being brought in contact with the circumference surface of the intermediate transfer belt 5 from the oblique left upper side in FIG. 4. The first auxiliary brush 61 is supported by a supporting member (not illustrated). A pretreatment by the first auxiliary brush 61 improves the removal efficiency of the remaining toner in the cleaning roller 51.

Figure 5:
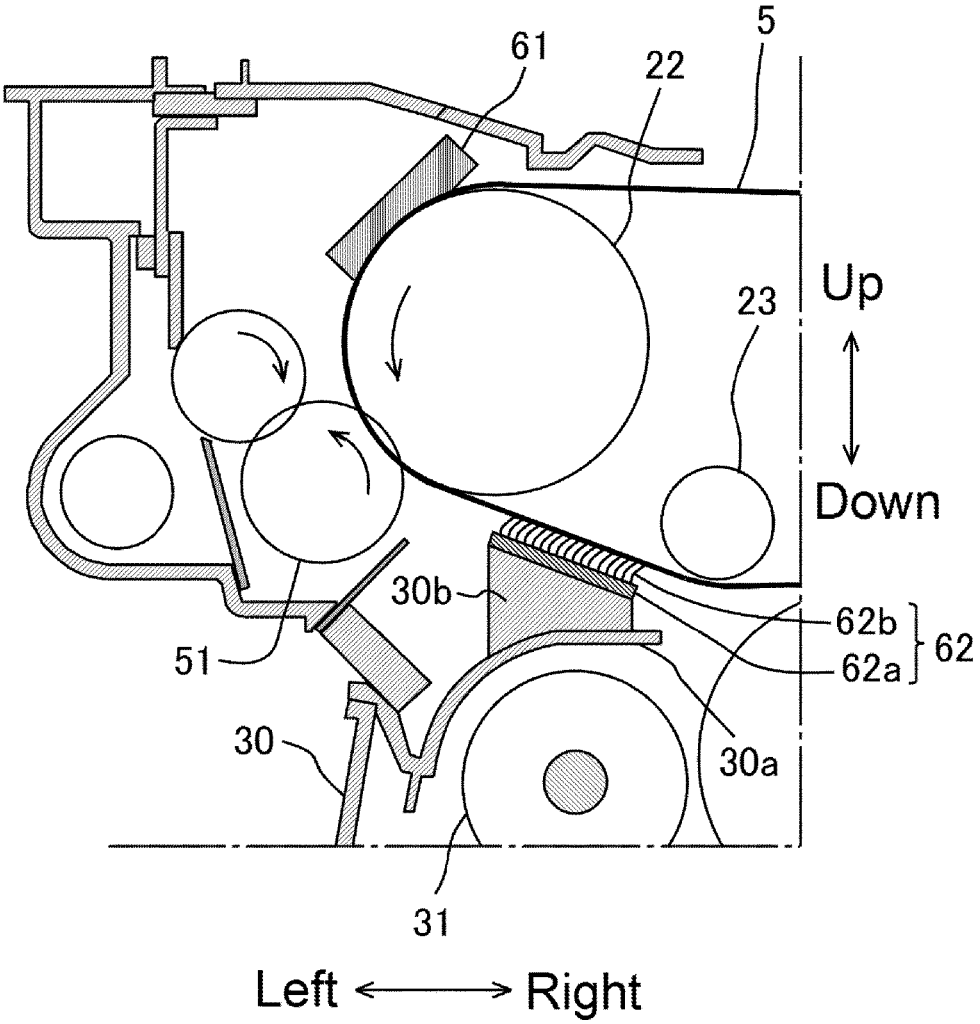
FIG. 5 illustrates an enlarged cross-sectional view near a second auxiliary brush in the image forming unit.

The second auxiliary brush 62 is a brush for removing paper powder or similar dust that has not been removed sufficiently by the cleaning roller 51. The second auxiliary brush 62 is located below the driven roller 22. The second auxiliary brush 62 is located on the top surface of the developer unit 13 at the most upstream side so as to close the clearance between the top surface (outside) of the developer unit 13 at the most upstream side and the lower surface of the intermediate transfer belt 5 over an axial direction (front-rear direction) of the driven roller 22. Specifically, as illustrated in FIG. 5, the second auxiliary brush 62 is located on the top surface of an upper-side cover portion 30*a* of the casing 30 of the developer unit 13 at the most upstream side. Of the intermediate transfer belt 5, the second auxiliary brush 62 is brought in contact between a contact portion with the driven roller 22 and a contact portion with a tension roller 23. The tension roller 23 is located between the primary transfer roller 14 of the image forming unit 10 at the most upstream side and the driven roller 22.

The second auxiliary brush 62 includes a substrate 62*a* and a brush unit 62*b*. The substrate 62*a* is secured to the top surface of the upper-side cover portion 30*a*. The brush unit 62*b* is constituted of many brush bristles planted to the substrate 62*a*. The substrate 62*a* is formed in a plate shape and is located on a projecting portion 30*b* of the upper-side cover portion 30*a*. The substrate 62*a* is located approximately in parallel to a portion (hereinafter referred to as "a brush abutting portion") with which the brush unit 62*b* is brought in contact, of the intermediate transfer belt 5. The brush unit 62*b* has an approximately uniform length of the brush bristle. In the embodiment, each of the plurality of brush bristles has a projection length from the substrate 62*a* (a planted surface) longer than a distance (hereinafter referred to as "a clearance distance") from the substrate 62*a* (the planted surface) at a planted position of the brush bristles to the intermediate transfer belt 5 such that, during rotation of the intermediate transfer belt 5, distal end sides of the plurality of brush bristles are pulled toward the downstream side by the intermediate transfer belt 5 and becomes an inclined state (a slightly laid state) relative to the intermediate transfer belt 5. Consequently, the plurality of brush bristles closely contact with the intermediate transfer belt 5.

Effects of Embodiment

Figure 6:
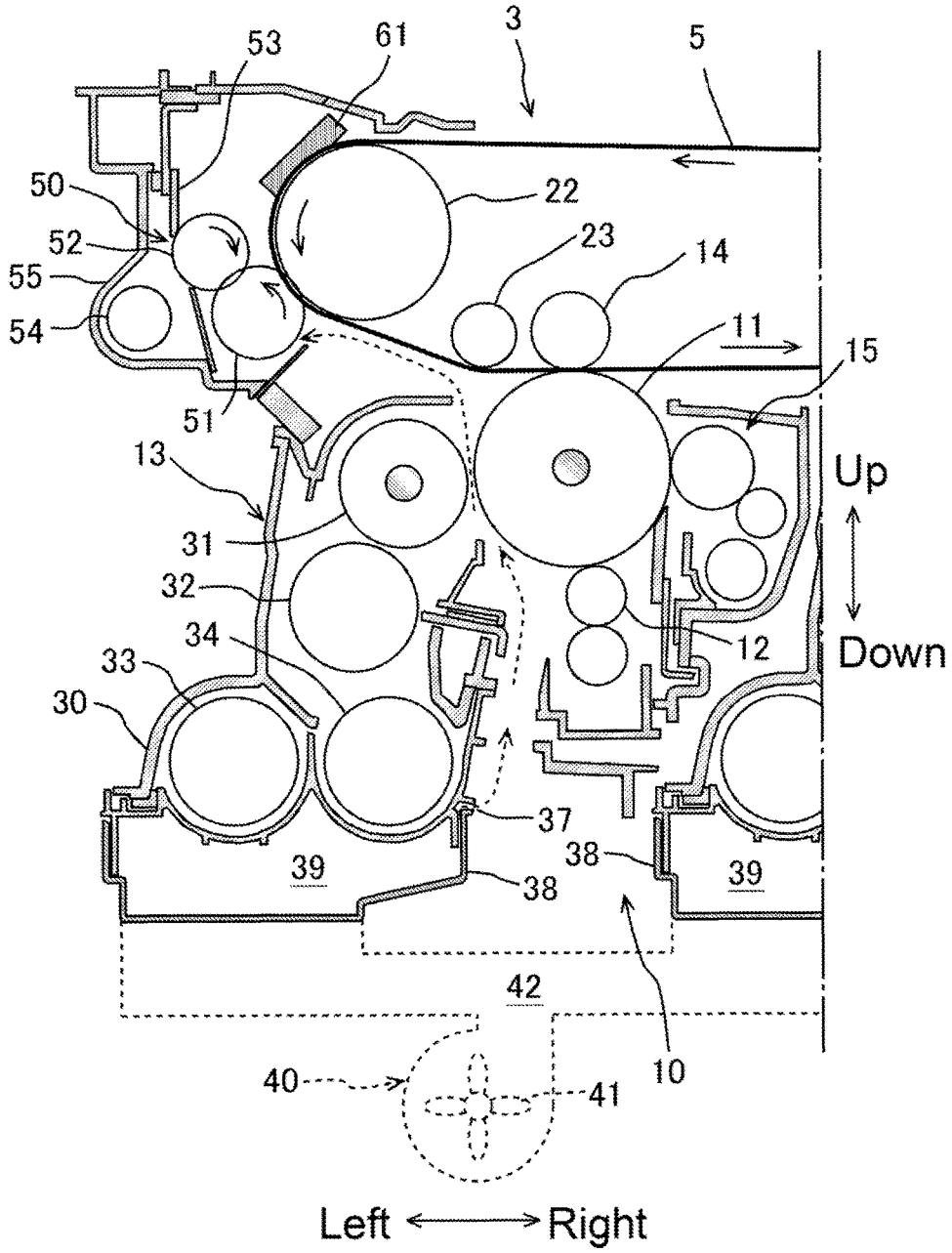
FIG. 6 RELATED ART
FIG. 6 illustrates a cross-sectional view for describing a problem of a conventional image forming apparatus.

Here, as illustrated in FIG. 6, in a conventional image forming apparatus that does not include the second auxiliary brush 62, the air flowing through the cooling duct 39 leaks out of, for example, a seam 37 between the sidewall portion of the duct-forming member 38 and the casing 30. As indicated by arrows of dashed lines, the air, which has leaked out of the cooling duct 39, passes through a clearance between the developing roller 31 and the photoreceptor drum 11 in the image forming unit 10 at the most upstream side. In that case, the toner on the developing roller 31 flies up, and then the toner scatters inside the image forming apparatus body 2 and is likely to attach to the component such as the intermediate transfer belt 5. This may cause the deterioration in quality of the image to be transferred onto the recording sheet P from the intermediate transfer belt 5.

The air, which has passed through the clearance between the developing roller 31 and the photoreceptor drum 11, further passes through the clearance between the intermediate transfer belt 5 and the developer unit 13 (the upper-side cover portion 30*a*) and then flows inside the casing 55, where the cleaning roller 51 and similar component are arranged. This causes the toner, which is removed from the intermediate transfer belt 5 by the cleaning roller 51 and is accumulated inside the casing 30, to fly up, and the toner is likely to attach to the cleaning roller 51 again, inside the casing 55. When the toner attaches to the cleaning roller 51 again, the toner attaches to the intermediate transfer belt 5 again, and in this state, the toner image is transferred onto the intermediate transfer belt 5 by the image forming unit 3. This may cause the deterioration in quality of the image to be transferred onto the recording sheet P from the intermediate transfer belt 5.

In contrast, in the embodiment, the clearance between the developer unit 13 at the most upstream side and the intermediate transfer belt 5 is closed by the second auxiliary brush 62 over the front-rear direction, and thus the air hardly passes through the clearance. The inside of the casing 55 becomes a state approximately sealed by the second auxiliary brush 62. Consequently, the air, which has leaked out of the cooling duct 39, is less likely to pass through the clearance between the developer unit 13 at the most upstream side and the intermediate transfer belt 5 and also hardly passes through the clearance between the photoreceptor drum 11 and the developing roller 31. Therefore, this ensures reducing the fly-up of the toner by the air, which has leaked out of the cooling duct 39 and ensures the reduced deterioration in the image quality caused by the fly-up.

In the embodiment, in order to remove the paper powder that has not been removed sufficiently from the intermediate transfer belt 5 by the cleaning roller 51, the second auxiliary brush 62 is located. Consequently, this ensures the reduced attachment of the paper powder to the photoreceptor drum 11 and ensures the reduced deterioration in the image quality caused by the attachment of the paper powder.

Other Embodiments

In the above-described embodiment the brush unit 62*b* of the second auxiliary brush 62 may be another constitution such as a sponge brush or similar material.

While in the above-described embodiment the projection length from the substrate 62*a* in each of the plurality of brush bristles is longer than the clearance distance at the planted position of the brush bristle, the projection length may be approximately equal to the clearance distance.

While in the above-described embodiment in the image forming apparatus 1, the air, which has leaked out of the cooling duct 39 of the cooling unit 40, which cools the developer unit 13, flows through between the developer unit 13 and the drum unit, air that leaks out of a cooling duct (not illustrated) of a cooling unit (not illustrated) that cools the light scanning device 4, may flows through between the developer unit 13 and the drum unit. In this case also, locating the second auxiliary brush 62 ensures reducing the scattering and the fly-up of the toner caused by the air that leaks out of the cooling duct of the cooling unit that cools the light scanning device 4.

While in the above-described embodiment the tandem type color printer as one example of the image forming apparatus 1 is described, this should not be construed in a limiting sense. The image forming apparatus 1 may be, for example, a copier, a multi-functional peripheral (MFP), or a facsimile.

As described above, the disclosure is useful for an image forming apparatus including a cleaning roller that removes a toner remaining on an intermediate transfer belt.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an intermediate transfer belt onto which a toner image formed on an image carrier is transferred; and a developer unit that faces the intermediate transfer belt with a clearance and forms the toner image by supplying toner to the image carrier; wherein the image forming apparatus rotatably drives the intermediate transfer belt, transfers the toner image formed on the image carrier onto the intermediate transfer belt, and forms an image by transferring the toner image transferred onto the intermediate transfer belt onto a transfer material; and the image forming apparatus includes a cooling unit that cools a predetermined component by sending air by a fan inside the image forming apparatus, a cleaning roller that removes remaining toner on the intermediate transfer belt at an upstream side of a region facing the developer unit in a rotationally moving direction of the intermediate transfer belt and at an upstream side of a region with which the image carrier is in contact in the intermediate transfer belt, and an auxiliary brush that is located on an outer surface of the developer unit so as to close the clearance between the intermediate transfer belt and the developer unit and is in contact with the intermediate transfer belt to clean the intermediate transfer belt.

2. The image forming apparatus according to claim 1, wherein:

the auxiliary brush includes a plurality of brush bristles and a planted surface on which the plurality of brush bristles are planted; and the plurality of brush bristles each have a projection length from the planted surface, the projection length being longer than a distance from the planted surface at a planted position of the brush bristles to the intermediate transfer belt such that, during rotation of the intermediate transfer belt, distal end sides of the plurality of brush bristles are pulled toward a downstream side by the intermediate transfer belt and becomes an inclined state relative to the intermediate transfer belt.

3. The image forming apparatus according to claim 1, wherein the cooling unit is configured to cool the developer unit.

* * * * *